US008189830B2

(12) United States Patent
Hou

(10) Patent No.: US 8,189,830 B2
(45) Date of Patent: May 29, 2012

(54) LIMITED USE HEARING AID

(75) Inventor: Zezheng Hou, Cupertino, CA (US)

(73) Assignee: Apherma, LLC, St. Paul, MN (US)

( * ) Notice: Subject to any disclaimer, the term of this patent is extended or adjusted under 35 U.S.C. 154(b) by 1230 days.

(21) Appl. No.: 11/846,020

(22) Filed: Aug. 28, 2007

(65) Prior Publication Data

US 2008/0049956 A1 Feb. 28, 2008

Related U.S. Application Data

(60) Provisional application No. 60/840,500, filed on Aug. 28, 2006.

(51) Int. Cl.
*H04R 25/00* (2006.01)

(52) U.S. Cl. ..... 381/312; 381/314; 381/321; 381/323; 381/60

(58) Field of Classification Search ..... 381/312, 381/314, 321, 323
See application file for complete search history.

(56) References Cited

U.S. PATENT DOCUMENTS 6,785,394 B1 * 8/2004 Olsen et al. ..... 381/312
2005/0254675 A1 * 11/2005 Sacha ..... 381/312
* cited by examiner

*Primary Examiner* — Steven Loke
*Assistant Examiner* — Cuong Nguyen
(74) *Attorney, Agent, or Firm* — Lock Lord LLP

(57) ABSTRACT

A hearing aid (or other assistive listening device) that is suitable for limited use is disclosed. The hearing aid can be configured to be usable for a predetermined period of time. After the expiration of the predetermined period of time, the hearing aid can cease to operate or operate in a degraded manner. Once the hearing aid has become significantly degraded, it can be either disposed of or reconfigured (or reprogrammed) so as to be usable for an additional period of time.

22 Claims, 1 Drawing Sheet

LIMITED USE HEARING AID

CROSS-REFERENCE TO OTHER APPLICATION

This application claims the benefit of U.S. Provisional Application No. 60/840,500, filed Aug. 28, 2006, and entitled "Disposable Hearing Aid", the contents of which is hereby incorporated by reference.

BACKGROUND OF THE INVENTION

Hearing aids operate to amplify sounds for users that are hearing impaired. FIG. 1 is a schematic of a conventional digital hearing aid system 100. The conventional digital hearing aid system 100 includes a microphone (MIC) 102 that picks up sound and converts it into electronic analog signals. An analog-to-digital (A/D) converter 104 converts the analog signals from the microphone 102 into digital signals. A digital signal processor (DSP) 106 operates to process the digital signals from the A/D converter 104. More particularly, the DSP 106 includes amplification circuitry and/or software processes that filter the digital signals to reduce unwanted components and also amplify desired components to compensate for hearing loss. A digital-to-analog (D/A) converter 108 can then converts the processed digital signals back to processed analog signals. Finally, the processed analog signals can be supplied to a receiver 110 to output amplified sounds.

Hearing aids are custom electronic devices that are expensive and personalized to particular users. Unfortunately, conventional hearing aids have an average life cycle of only about five (5) years. In addition to a rather short life cycle, hearing aids are likely to require maintenance or repairs after being in use for one (1) year. These shortcomings of conventional hearing aids are a burden for both hearing aid users and hearing aid manufacturers. For hearing aid users, a repair usually means they will not have hearing assistance for several days. Additionally, if their hearing aid is out of warranty, users are saddled with significant repair expenses. For hearing aid manufacturers, the cost of the repairs is high due to costs associated with shipping, components, skilled labor and equipment for servicing both new and old products. These high repair costs also lead manufacturers to charge relatively high prices for purchase of hearing aids.

Disposable hearing aids offer an alternative to these problems. However, current disposable hearing aids are based on battery life and have several drawbacks. The most significant drawback is its life cycle. Because it is desired to make a hearing aid as small as possible, its battery size is limited. Current disposable hearing aids are dependent on battery life and thus have very short life cycles—just over a month. Because other components of the disposable hearing aids are relatively expensive, the overall cost for disposable hearing aids is still high. As a result, the conventional disposable hearing aids are frequently too expensive for users.

Thus, there is a need for limited use hearing aids (or other assistive listening devices) that are available at lower prices and have longer and/or configurable life cycles.

SUMMARY OF THE INVENTION

The invention relates to a hearing aid (or other assistive listening device) that is suitable for limited use. The hearing aid can be configured to be usable for a predetermined period of time. After the expiration of the predetermined period of time, the hearing aid can cease to operate or operate in a degraded manner. Once the hearing aid has become significantly degraded, it can be either disposed of or reconfigured (or reprogrammed) so as to be usable for an additional period of time.

The invention can be implemented in numerous ways, including as a method, system, device, apparatus, or computer readable medium. Several embodiments of the invention are discussed below.

As a digital hearing aid, one embodiment includes at least: a microphone for picking up sound and producing analog sound signals; an analog-to-digital converter configured to convert the analog sound signals to digital sound signals; a processing unit including at least amplification logic, the amplification logic being configured to amplify the digital sound signals in accordance with parameters; performance deterioration logic configured to cause degradation of amplification to the digital sound signals by the processing unit; a data storage device storing the parameters; a digital-to-analog converter configured to convert the processed digital sound signals to processed analog sound signals; and an audio output device capable of outputting sound in accordance with the processed analog sound signals.

As a method for operating a hearing aid, one embodiment of the invention includes at least the acts of: configuring the hearing aid for a predetermined usage period; determining whether the hearing aid has been in use for the predetermined usage period; and degrading performance of the hearing aid when the hearing aid has been in use for more than the predetermined usage period.

As a digital hearing aid, another embodiment includes at least: a microphone for picking up sound and producing analog sound signals; an analog-to-digital converter configured to convert the analog sound signals to digital sound signals; a processing unit including at least amplification logic, the amplification logic being configured to amplify the digital sound signals in accordance with parameters; performance deterioration means for causing degradation of amplification to the digital sound signals by the processing unit; a digital-to-analog converter configured to convert the processed digital sound signals to processed analog sound signals; and an audio output device coupled to the digital-to-analog converter, the audio output device capable of outputting sound in accordance with the processed analog sound signals.

As a digital hearing aid, still another embodiment includes at least: a microphone for picking up sound and producing analog sound signals; an analog-to-digital converter configured to convert the analog sound signals to digital sound signals; a processing unit including at least amplification logic, the amplification logic being configured to amplify the digital sound signals in accordance with parameters; a lifecycle control unit permits operation of the digital hearing aid during a predetermined lifecycle metric, and impedes operation of the digital hearing aid beyond a predetermined lifecycle metric; a digital-to-analog converter configured to convert the processed digital sound signals to processed analog sound signals; and an audio output device capable of outputting sound in accordance with the processed analog sound signals.

Other aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION OF THE INVENTION

The invention relates to a hearing aid (or other assistive listening device) that is suitable for limited use. The hearing aid can be configured to be usable for a predetermined period of time. After the expiration of the predetermined period of time, the hearing aid can cease to operate or operate in a degraded manner. Once the hearing aid has become significantly degraded, it can be either disposed of or reconfigured (or reprogrammed) so as to be usable for an additional period of time.

According to one aspect of the invention, a hearing aid can be configured to fully operate only for a limited period of time. The period of time can, for example, be a determined number of days of use. For example, a user may acquire a hearing aid that is operational for ninety (90) days. As another example, a user may lease a hearing aid for one (1) year. After an authorized period of use has been exceeded, the hearing aid can degrade its performance such that the hearing aid becomes less useful. The manner, degree or rate of performance degradation can be dependent on implementation. Such a hearing aid can be considered a limited use hearing aid, a controlled duration hearing aid, or a disposable hearing aid.

A hearing aid can also be reprogrammable to provide a renewed life cycle. For example, after an authorized period of use, the user of the hearing aid can be motivated by the performance degradation to purchase another limited use hearing aid or purchase (rent, lease) addition usage time on their existing hearing aid. In such case, the existing hearing aid can be reprogrammed (or reconfigured) to provide a renewed life cycle. The invention thus facilitates a variety of payment for use scenarios for hearing aids capable of operating for determined periods of time. As an example, some hearing impaired individuals may want to obtain a hearing aid under a rental or lease contract. In particular, a user may want to try a particular hearing aid for a few months before making a long term commitment.

Embodiments of the invention are discussed below with reference to FIG. 2. However, those skilled in the art will readily appreciate that the detailed description given herein with respect to these figures is for explanatory purposes as the invention extends beyond these limited embodiments.

Figure 1:
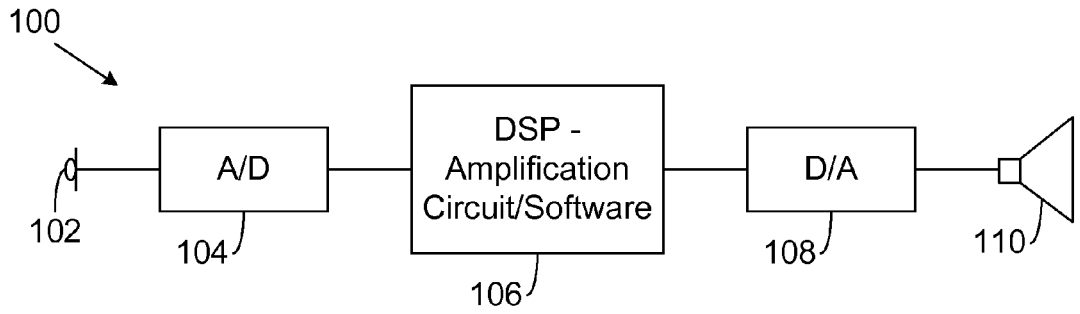
FIG. 1 is a schematic of a conventional digital hearing aid system.
Figure 2:
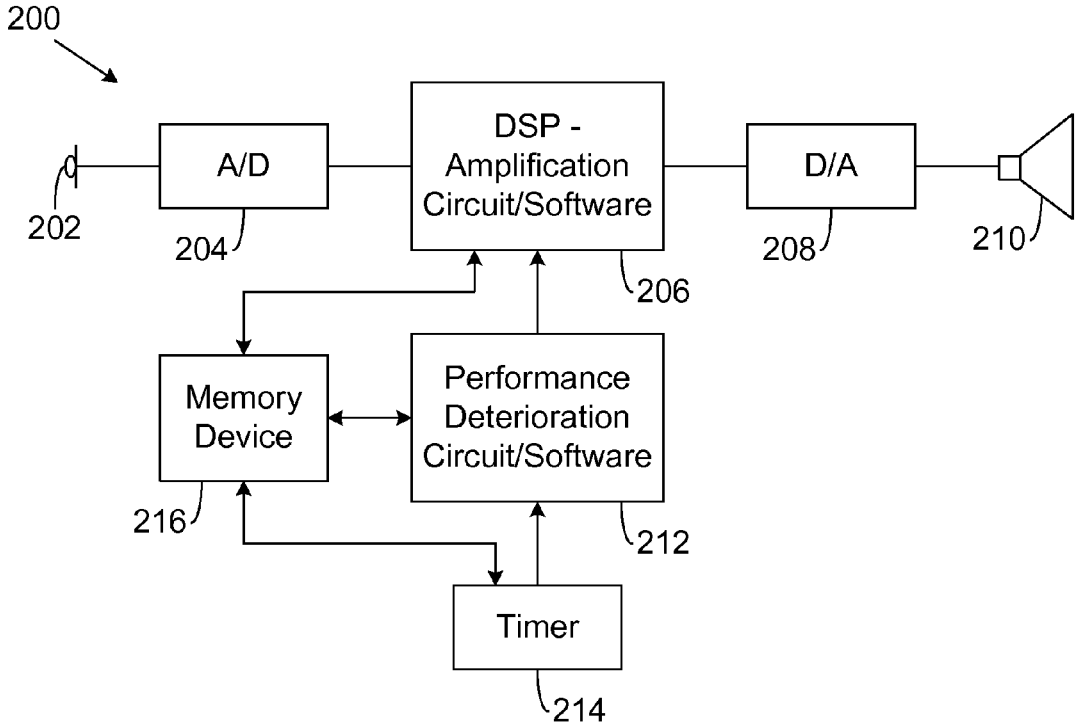
FIG. 2 is a schematic of a digital hearing aid system according to one embodiment of the invention.

FIG. 2 is a schematic of a digital hearing aid system 200 according to one embodiment of the invention. The digital hearing aid system 200 includes a microphone (MIC) 202 that picks up sound and converts it into electronic analog signals. An analog-to-digital (A/D) converter 204 converts the analog signals from the microphone 202 into digital signals. A digital signal processor (DSP) 206 operates to process the digital signals from the A/D converter 204. More particularly, the DSP 206 includes amplification circuitry and/or software processes that filter the digital signals to reduce unwanted components and also amplify desired components to compensate for hearing loss. A digital-to-analog (D/A) converter 208 can then convert the processed digital signals back to processed analog signals. Finally, the processed analog signals can be supplied to a receiver 210 to output amplified sounds.

The digital hearing aid system 200 also includes a performance deterioration circuitry/software 212 and a timer 214. In general, the timer 214 monitors time-in-use of the digital hearing aid system 200. The time-in-use can be compared to a predetermined available usage time associated with the digital hearing aid system 200. When the time-in-use exceeds the predetermined available usage time, the performance deterioration circuitry/software 212 can operates to degrade the operation of the digital hearing aid 200. In general, the performance deterioration circuit/software 212 can interface with the DSP 206 to cause degradation in performance.

The digital hearing aid system 200 can further include a memory device 216. The memory device 216 can store parameters for the DSP 206 and can store time-in-use and/or boot counts for the timer 214 or the performance deterioration circuitry/software 212. The memory device 216 is a data store device that provides non-volatile data storage. For example, the memory device 216 can be implemented by Flash memory or EEPROM. The memory device 216 can be provided separately or can be provided internal to any one or more of the DSP 206, the performance deterioration circuitry/software 212 or the timer 212. The memory device 216 can also be distributed across different components, such as when data storage is provided in multiple ones of the DSP 206, the performance deterioration circuitry/software 212 or the timer 212.

The performance degradation caused by the performance deterioration circuitry/software 212 can be implemented in a variety of different ways. In one embodiment, the performance deterioration circuitry/software 212 causes the amplification of the digital hearing aid system 200 (i.e., the DSP 206) to be gradually reduced over time. In another embodiment, the performance deterioration circuitry/software 212 causes the amplification of the digital hearing aid system 200 to be reduced by a small amount after each specified time period passes. In another embodiment, the performance deterioration circuitry/software 212 causes the amplification of the digital hearing aid system 200 to be reduced by a small amount each time the hearing aid 200 is restarted (rebooted). In another embodiment, the performance deterioration circuitry/software 212 causes the amplification of the hearing aid 200 to stop after a pre-specified time period.

When the amplification by the digital hearing aid 200 is altered to degrade performance, the manner by which the amplification is altered can also vary. In one embodiment, the amplification (i.e., gain) provided by the DSP 206 could, for example, be reduced from about 0.1-1 dB per day (or per reboot). In one implementation, the amplification reduction is executed across all frequencies. In another implementation, the amplification reduction is executed for only certain frequencies. In another embodiment, the frequency range of amplification can be narrowed from about 10-500 Hertz per day, for example, starting at higher frequencies. As an example, a typically amplification range for a hearing aid might be 50-6000 Hertz, and once degradation starts, the amplification can shrink to 50-5500 Hertz following its first degradation step of 500 Hertz.

In another embodiment, the performance deterioration circuitry/software 212 can issue, or cause to be issued, a warning signal, such as an audio warning sound or message for the user of the digital hearing aid system 200. The amplitude or how often the message is presented can increase over time to increase the level of performance degradation.

As noted above, the timer 214 can be used to determine when performance deterioration should be performed for the digital hearing aid system 200. In one embodiment, the timer 214 signals the performance deterioration circuitry/software 212 to degrade the operation of the digital hearing aid system 200. The performance deterioration circuitry/software 212 can interact with the DSP 206 to degrade performance. The timer 214 can be implemented in hardware and/or software.

In one embodiment, the timer 214 records an accumulative duration (length) that the digital hearing aid system 200 has been used and can issue an indicator signal when the accumulative duration is greater than a pre-selected value. In another embodiment, the timer 214 records an accumulative number of times the digital hearing aid 200 has been turned on and can issue an indicator signal when the accumulative number is greater than a pre-selected value.

Given that the digital hearing aid system 200 is powered by a battery, the digital hearing aid system 200 can further include a memory device for storage of the time-in-use as well as the configured life cycle for the digital hearing aid system 200. The timer 214 can update the elapsed time-in-use stored in the memory. For example, the elapsed time-in-use can be stored to the memory device periodically (e.g., hourly). The memory device provides non-volatile data storage for the time-in-use, configured life cycle, etc. In one embodiment, the memory device is a Flash memory or EEPROM. Hence, in one embodiment, even if the battery for the digital hearing aid system 200 is exhausted and replaced, the accumulated usage data and life cycle configuration data can be preserved. The digital hearing aid system 200 might also store other data in the memory device such as a count of the number of time the device was booted/rebooted (i.e., activated). Performance degradation could also be initiated when the boot count exceeds a threshold count.

Further, in one embodiment, the timer 214 can be reset and/or be programmable. In one embodiment, reset of the timer 214 can be done by another computing device. In another embodiment, reset of the timer 214 can be is done via a remote network, including, but not limited to, Internet, telephone line, cell phone, or other remote control.

The various aspects, features, embodiments or implementations of the invention described above can be used alone or in various combinations.

The invention is preferably implemented by software, hardware, or a combination of hardware and software. The invention can also be embodied as computer readable code on a computer readable medium. The computer readable medium is any data storage device that can store data which can thereafter be read by a computer system. Examples of the computer readable medium generally include read-only memory and random-access memory. More specific examples of computer readable medium are tangible and include Flash memory, EEPROM memory, memory card, CD-ROM, DVD, hard drive, magnetic tape, and optical data storage device. The computer readable medium can also be distributed over network-coupled computer systems so that the computer readable code is stored and executed in a distributed fashion.

The advantages of the invention are numerous. Different aspects, embodiments or implementations may, but need not, yield one or more of the following advantages. One advantage of the invention is that hearing aids can be configured for limited use. Another advantage of the invention is that a hearing aid can operate to degrade its performance under certain conditions, such as a predetermined usage period. Another advantage of the invention is that a previously degraded hearing aid can be subsequently reconfigured to resume operation at fully performance. Still another advantage of the invention is that users of hearing aids can be alerted when their pre-established usage period is expired or expiring.

The many features and advantages of the present invention are apparent from the written description. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. A digital hearing aid, comprising:

a microphone for picking up sound and producing analog sound signals;

an analog-to-digital converter coupled to the microphone, the analog-to-digital converter configured to convert the analog sound signals to digital sound signals;

a processing unit coupled to the analog-to-digital converter, the processing unit including at least amplification logic, the amplification logic being configured to amplify the digital sound signals in accordance with parameters;

a performance deterioration logic circuit operatively connected or included within the processing unit, the performance deterioration logic circuit being configured to cause degradation of amplification to the digital sound signals by the processing unit by a predefined amount each time the digital hearing aid is restarted or rebooted;

a data storage device coupled to the processing unit, the data storage device storing the parameters;

a digital-to-analog converter coupled to the processing unit, the digital-to-analog converter configured to convert the processed digital sound signals to processed analog sound signals; and an audio output device coupled to the digital-to-analog converter, the audio output device capable of outputting sound in accordance with the processed analog sound signals.

2. A digital hearing aid as recited in claim 1, wherein digital hearing aid further comprises:

a timer that monitors time-in-use of the digital hearing aid.

3. A digital hearing aid as recited in claim 2, wherein the performance deterioration logic circuit causes degradation of amplification to the digital sound signals by the processing unit when the time-in-use exceeds a predetermined available usage time.

4. A digital hearing aid as recited in claim 2, wherein the digital hearing aid system compares the time-in-use to a predetermined available usage time associated with the digital hearing aid system to produce comparison information, and wherein the performance deterioration logic circuit causes degradation of amplification to the digital sound signals by the processing unit when the time-in-use exceeds a predetermined available usage time.

5. A digital hearing aid as recited in claim 4, wherein the performance deterioration logic circuit further causes return to unimpeded amplification to the digital sound signals by the processing unit when the digital hearing aid is subsequently provided with additional time-in-use.

6. A digital hearing aid as recited in claim 4, wherein the time-in-use is stored in the data storage device.

7. A digital hearing aid as recited in claim 1, wherein the processing unit is a digital signal processor.

8. A digital hearing aid as recited in claim 1, wherein the degradation of amplification to the digital sound signals by the processing unit is achieved gradually over time.

9. A digital hearing aid as recited in claim 1, wherein the degradation of amplification to the digital sound signals by the processing unit is achieved by reducing amplification gain gradually over time.

10. A digital hearing aid as recited in claim 1, wherein the degradation of amplification to the digital sound signals by the processing unit is achieved by narrowing frequency range of amplification gradually over time.

11. A digital hearing aid as recited in claim 1, wherein the degradation of amplification to the digital sound signals by the processing unit is achieved by reducing amplification gain or narrowing frequency range.

12. A digital hearing aid as recited in claim 1, wherein the digital hearing aid can further produce an audio warning sound or message for a user of the digital hearing aid system.

13. A digital hearing aid as recited in claim 1, wherein the hearing aid outputs digital sound signals after the degradation of amplification to the digital sound signals.

14. A method for operating a hearing aid, said method comprising:

configuring the hearing aid for a predetermined usage period;

determining whether the hearing aid has been in use for the predetermined usage period; and degrading performance of the hearing aid by causing degradation of amplification to digital sound signals by reducing amplification gain or narrowing frequency range to the digital sound signals to be output by the hearing aid by a predefined amount each time the hearing aid is restarted or rebooted.

15. A method as recited in claim 14, wherein said method further comprises:

subsequently reconfiguring the hearing aid for an additional usage period and resuming unimpeded performance of the hearing aid for the additional usage period.

16. A method as recited in claim 14, wherein said degrading of performance of the hearing aid comprises reducing amplification gain gradually over time.

17. A method as recited in claim 14, wherein said degrading of performance of the hearing aid comprises narrowing frequency range of amplification gradually over time.

18. A method as recited in claim 14, wherein the hearing aid outputs digital sound signals after the performance deterioration means causes degradation of amplification to the digital sound signals.

19. A digital hearing aid, comprising:

a microphone for picking up sound and producing analog sound signals;

an analog-to-digital converter coupled to the microphone, the analog-to-digital converter configured to convert the analog sound signals to digital sound signals;

a processing unit coupled to the analog-to-digital converter, the processing unit including at least amplification logic, the amplification logic being configured to amplify the digital sound signals in accordance with parameters;

a performance deterioration logic circuit for causing degradation of amplification to the digital sound signals by the processing unit by a predefined amount each time the digital hearing aid is restarted or rebooted;

a digital-to-analog converter coupled to the processing unit, the digital-to-analog converter configured to convert the processed digital sound signals to processed analog sound signals; and an audio output device coupled to the digital-to-analog converter, the audio output device capable of outputting sound in accordance with the processed analog sound signals.

20. A digital hearing aid as recited in claim 19, wherein the hearing aid outputs digital sound signals after the degrading performance causes degradation of amplification to the digital sound signals.

21. A digital hearing aid, comprising:

a microphone for picking up sound and producing analog sound signals;

an analog-to-digital converter coupled to the microphone, the analog-to-digital converter configured to convert the analog sound signals to digital sound signals;

a processing unit coupled to the analog-to-digital converter, the processing unit including at least amplification logic, the amplification logic being configured to amplify the digital sound signals in accordance with parameters;

a performance deterioration logic circuit configured to cause degradation of amplification to digital sound signals by a predefined amount each time the digital hearing aid is restarted or rebooted;

a digital-to-analog converter coupled to the processing unit, the digital-to-analog converter configured to convert the processed digital sound signals to processed analog sound signals; and an audio output device coupled to the digital-to-analog converter, the audio output device capable of outputting sound in accordance with the processed analog sound signals, wherein the audio output device outputs digital sound signals after degradation of amplification to the digital sound signals.

22. A digital hearing aid as recited in claim 21, further comprising a lifecycle control unit coupled or internal to the processing unit, the lifecycle control unit permits operation of the digital hearing aid during a predetermined lifecycle metric, and impedes operation of the digital hearing aid beyond a predetermined lifecycle metric.

* * * * *